US011920449B2

(12) United States Patent
Broussard et al.

(10) Patent No.: US 11,920,449 B2
(45) Date of Patent: Mar. 5, 2024

(54) SYSTEM FOR CENTRALIZED MONITORING AND CONTROL OF ELECTRIC POWERED HYDRAULIC FRACTURING FLEET

(71) Applicant: U.S. Well Services, LLC, Houston, TX (US)

(72) Inventors: Joel N. Broussard, Lafayette, LA (US); Jeff McPherson, Fairmont, WV (US); Robert Kurtz, Fairmont, WV (US); Jared Oehring, Houston, TX (US); Brandon Hinderliter, Houston, TX (US)

(73) Assignee: U.S. WELL SERVICES, LLC, Houston, TX (US)

( * ) Notice: Subject to any disclaimer, the term of this patent is extended or adjusted under 35 U.S.C. 154(b) by 0 days.

(21) Appl. No.: 17/402,752

(22) Filed: Aug. 16, 2021

(65) Prior Publication Data

US 2022/0213772 A1 Jul. 7, 2022

Related U.S. Application Data

(63) Continuation of application No. 15/978,838, filed on May 14, 2018, now Pat. No. 11,091,992, which is a (Continued)

(51) Int. Cl.
*E21B 43/26* (2006.01)

(52) U.S. Cl.
CPC ..... *E21B 43/2607* (2020.05)

(58) Field of Classification Search
CPC ..... E21B 43/26; E21B 41/0092
See application file for complete search history.

(56) References Cited

U.S. PATENT DOCUMENTS 2,976,025 A 3/1961 Pro
4,411,313 A 10/1983 Johnson et al.
(Continued)

FOREIGN PATENT DOCUMENTS

WO 2009046280 4/2009
WO 2014177346 11/2014
WO 2019210417 11/2019

OTHER PUBLICATIONS

Kroposki et al., Making Microgrids Work, 6 IEEE Power and Energy Mag. 40, 41 (2008).
(Continued)

*Primary Examiner* — Kenneth L Thompson
(74) *Attorney, Agent, or Firm* — HOGAN LOVELLS US LLP

(57) ABSTRACT

A system and method are disclosed for centralized monitoring and control of a hydraulic fracturing operation. The system includes an electric powered fracturing fleet and a centralized control unit coupled to the electric powered fracturing fleet. The electric powered fracturing fleet can include a combination of one or more of: electric powered pumps, turbine generators, blenders, sand silos, chemical storage units, conveyor belts, manifold trailers, hydration units, variable frequency drives, switchgear, transformers, and compressors. The centralized control unit can be configured to monitor and/or control one or more operating characteristics of the electric powered fracturing fleet.

17 Claims, 3 Drawing Sheets

Related U.S. Application Data continuation of application No. 14/884,363, filed on Oct. 15, 2015, now Pat. No. 9,970,278, which is a continuation-in-part of application No. 13/679,689, filed on Nov. 16, 2012, now Pat. No. 9,410,410.

(56) References Cited

U.S. PATENT DOCUMENTS

| | | | | |
|---|---|---|---|---|
| 4,538,916 | A | 9/1985 | Zimmerman | |
| 4,601,629 | A | 7/1986 | Zimmerman | |
| 4,768,884 | A | 9/1988 | Elkin | |
| 5,486,047 | A | 1/1996 | Zimmerman | |
| 5,685,155 | A * | 11/1997 | Brown | F02C 1/00 60/659 |
| 5,813,455 | A | 9/1998 | Pratt et al. | |
| 6,097,310 | A | 8/2000 | Harrell et al. | |
| 6,161,386 | A * | 12/2000 | Lokhandwala | B01D 53/22 60/671 |
| 6,273,193 | B1 | 8/2001 | Hermann et al. | |
| 6,442,942 | B1 | 9/2002 | Kopko | |
| 6,585,455 | B1 | 7/2003 | Petersen et al. | |
| 7,946,340 | B2 * | 5/2011 | Surjaatmadja | E21B 43/267 166/308.1 |
| 8,001,790 | B2 * | 8/2011 | Ichiryu | F01D 25/28 60/797 |
| 8,342,246 | B2 * | 1/2013 | Vandor | C09K 8/80 166/308.4 |
| 8,997,904 | B2 * | 4/2015 | Cryer | H02K 7/1823 180/53.5 |
| 9,140,105 | B2 | 9/2015 | Pattillo | |
| 9,324,049 | B2 * | 4/2016 | Thomeer | E21B 41/0092 |
| 9,353,593 | B1 | 5/2016 | Lu et al. | |
| 9,366,114 | B2 * | 6/2016 | Coli | F04B 23/06 |
| 9,410,410 | B2 * | 8/2016 | Broussard | F01D 15/10 |
| 9,534,473 | B2 * | 1/2017 | Morris | F01D 15/00 |
| 9,790,858 | B2 | 10/2017 | Kanebako | |
| 9,945,365 | B2 | 4/2018 | Hernandez et al. | |
| 9,970,278 | B2 * | 5/2018 | Broussard | E21B 43/26 |
| 10,151,244 | B2 * | 12/2018 | Giancotti | F02C 7/20 |
| 10,246,984 | B2 * | 4/2019 | Payne | E21B 21/062 |
| 10,648,270 | B2 | 5/2020 | Brunty et al. | |
| 10,686,301 | B2 | 6/2020 | Oehring et al. | |
| 10,731,561 | B2 | 8/2020 | Oehring et al. | |
| 10,767,561 | B2 | 9/2020 | Brady | |
| 10,781,752 | B2 | 9/2020 | Kikkawa et al. | |
| 10,988,998 | B2 | 4/2021 | Fischer et al. | |
| 11,091,992 | B2 * | 8/2021 | Broussard | E21B 43/26 |
| 11,492,886 | B2 * | 11/2022 | Oehring | E21B 34/08 |
| 2004/0045703 | A1 | 3/2004 | Hooper et al. | |
| 2007/0125544 | A1 * | 6/2007 | Robinson | E21B 43/26 166/305.1 |
| 2012/0112757 | A1 | 5/2012 | Vrankovic et al. | |
| 2013/0051971 | A1 | 2/2013 | Wyse et al. | |
| 2013/0118750 | A1 * | 5/2013 | Gu | E21B 43/26 166/308.1 |
| 2013/0306322 | A1 * | 11/2013 | Sanborn | E21B 43/2607 166/308.1 |
| 2014/0174717 | A1 | 6/2014 | Broussard et al. | |
| 2016/0230660 | A1 | 8/2016 | Zeitoun et al. | |
| 2018/0366950 | A1 | 12/2018 | Pedersen et al. | |
| 2020/0040878 | A1 | 2/2020 | Morris | |
| 2020/0325760 | A1 | 10/2020 | Markham | |
| 2020/0350790 | A1 | 11/2020 | Luft et al. | |

OTHER PUBLICATIONS

Dan T. Ton & Merrill A. Smith, The U.S. Department of Energy's Microgrid Initiative, 25 The Electricity J. 84 (2012), pp. 84-94.

Non-Final Office Action issued in U.S. Appl. No. 16/871,328 dated Dec. 9, 2021.

Non-Final Office Action issued in U.S. Appl. No. 16/943,935 dated Oct. 21, 2021.

Non-Final Office Action issued in U.S. Appl. No. 16/564,186, dated Oct. 15, 2021.

Final Office Action issued in U.S. Appl. No. 16/356,263 dated Oct. 7, 2021.

Non-Final Office Action issued in U.S. Appl. No. 17/060,647 dated Sep. 20, 2021.

Non-Final Office Action issued in U.S. Appl. No. 16/901,774 dated Sep. 14, 2021.

Canadian Office Action issued in Canadian Application No. 3,094,768 dated Oct. 28, 2021.

* cited by examiner

SYSTEM FOR CENTRALIZED MONITORING AND CONTROL OF ELECTRIC POWERED HYDRAULIC FRACTURING FLEET

CROSS-REFERENCE TO RELATED APPLICATION

This application claims priority to and is a continuation of U.S. patent application Ser. No. 15/978,838, filed on May 14, 2018, now U.S. Pat. No. 11,091,992, issued Aug. 17, 2021, and titled "System for Centralized Monitoring and Control of Electric Powered Hydraulic Fracturing Fleet," which is a continuation of U.S. patent application Ser. No. 14/884,363, filed on Oct. 15, 2015, now U.S. Pat. No. 9,970,278, issued May 15, 2018 and titled "System for Centralized Monitoring and Control of Electric Powered Hydraulic Fracturing Fleet," which is a continuation-in-part of U.S. patent application Ser. No. 13/679,689, filed on Nov. 16, 2012, now U.S. Pat. No. 9,410,410, issued Aug. 9, 2016 and titled "System for Pumping Hydraulic Fracturing Fluid Using Electric Pumps," the content of which is incorporated herein by reference.

BACKGROUND OF THE INVENTION

This technology relates to hydraulic fracturing in oil and gas wells. In particular, this technology relates to pumping fracturing fluid into an oil or gas well using equipment powered by electric motors, as well as centralized monitoring and control for various controls relating to the wellsite operations.

Hydraulic fracturing has been used for decades to stimulate production from oil and gas wells. The practice consists of pumping fluid into a wellbore at high pressure. Inside the wellbore, the fluid is forced into the formation being produced. When the fluid enters the formation, it fractures, or creates fissures, in the formation. Water, as well as other fluids, and some solid proppants, are then pumped into the fissures to stimulate the release of oil and gas from the formation.

Fracturing rock in a formation requires that the slurry be pumped into the wellbore at very high pressure. This pumping is typically performed by large diesel-powered pumps. Such pumps are able to pump fracturing fluid into a wellbore at a high enough pressure to crack the formation, but they also have drawbacks. For example, the diesel pumps are very heavy, and thus must be moved on heavy duty trailers, making transport of the pumps between oilfield sites expensive and inefficient. In addition, the diesel engines required to drive the pumps require a relatively high level of expensive maintenance. Furthermore, the cost of diesel fuel is much higher than in the past, meaning that the cost of running the pumps has increased.

Additionally, when using diesel-powered pumps, each pump had to be individually manually monitored and controlled, frequently by operators communicating by radio around the wellsite. Fracturing fleets employing diesel-powered pumps do not use gas turbines, generators, switchgear, or transformers, and lack gas compression, therefore have no need to monitor such equipment.

SUMMARY OF THE INVENTION

Disclosed herein is a system for hydraulically fracturing an underground formation in an oil or gas well to extract oil or gas from the formation, the oil or gas well having a wellbore that permits passage of fluid from the wellbore into the formation. The system includes a plurality of electric pumps fluidly connected to the well, and configured to pump fluid into the wellbore at high pressure so that the fluid passes from the wellbore into the formation, and fractures the formation. The system also includes a plurality of generators electrically connected to the plurality of electric pumps to provide electrical power to the pumps. At least some of the plurality of generators can be powered by natural gas. In addition, at least some of the plurality of generators can be turbine generators. The system can also include a centralized control unit coupled to the plurality of electric pumps and the plurality of generators. The centralized control unit monitors at least one of pressure, temperature, fluid rate, fluid density, concentration, volts, amps, etc. of the plurality of electric pumps and the plurality of generators.

Also disclosed herein is a process for stimulating an oil or gas well by hydraulically fracturing a formation in the well. The process includes the steps of pumping fracturing fluid into the well with an electrically powered pump or fleet of pumps at a high pressure so that the fracturing fluid enters and cracks the formation, the fracturing fluid having at least a liquid component and (typically) a solid proppant, and inserting the solid proppant into the cracks to maintain the cracks open, thereby allowing passage of oil and gas through the cracks. The process can further include powering the electrically powered pump or fleet of pumps with a generator powered by natural gas, diesel, propane or other hydrocarbon fuels, such as, for example, a turbine generator. The process can further include monitoring at a centralized control unit at least one of pressure, temperature, fluid rate, fluid density, concentration, volts, amps, etc. of the plurality of electric pumps and the plurality of generators.

Also disclosed is a system for centralized monitoring and control of an electrically powered hydraulic fracturing operation. The system can include, for example, an electric powered fracturing fleet. The electric powered fracturing fleet can include a combination of one or more of: electric powered pumps, turbine generators, blenders, sand silos, chemical storage units, conveyor belts, manifold trailers, hydration units, variable frequency drives, switchgear, transformers, and compressors. The electric powered fracturing fleet can also include a centralized control unit coupled to electric powered fracturing fleet. The centralized control unit is configured to monitor one or more operating characteristics of the electric powered fracturing fleet and control one or more operating characteristics of the electric powered fracturing fleet.

BRIEF DESCRIPTION OF THE DRAWINGS

The present technology will be better understood on reading the following detailed description of nonlimiting embodiments thereof, and on examining the accompanying drawing, in which.

DETAILED DESCRIPTION OF THE PREFERRED EMBODIMENT

Figure 1:
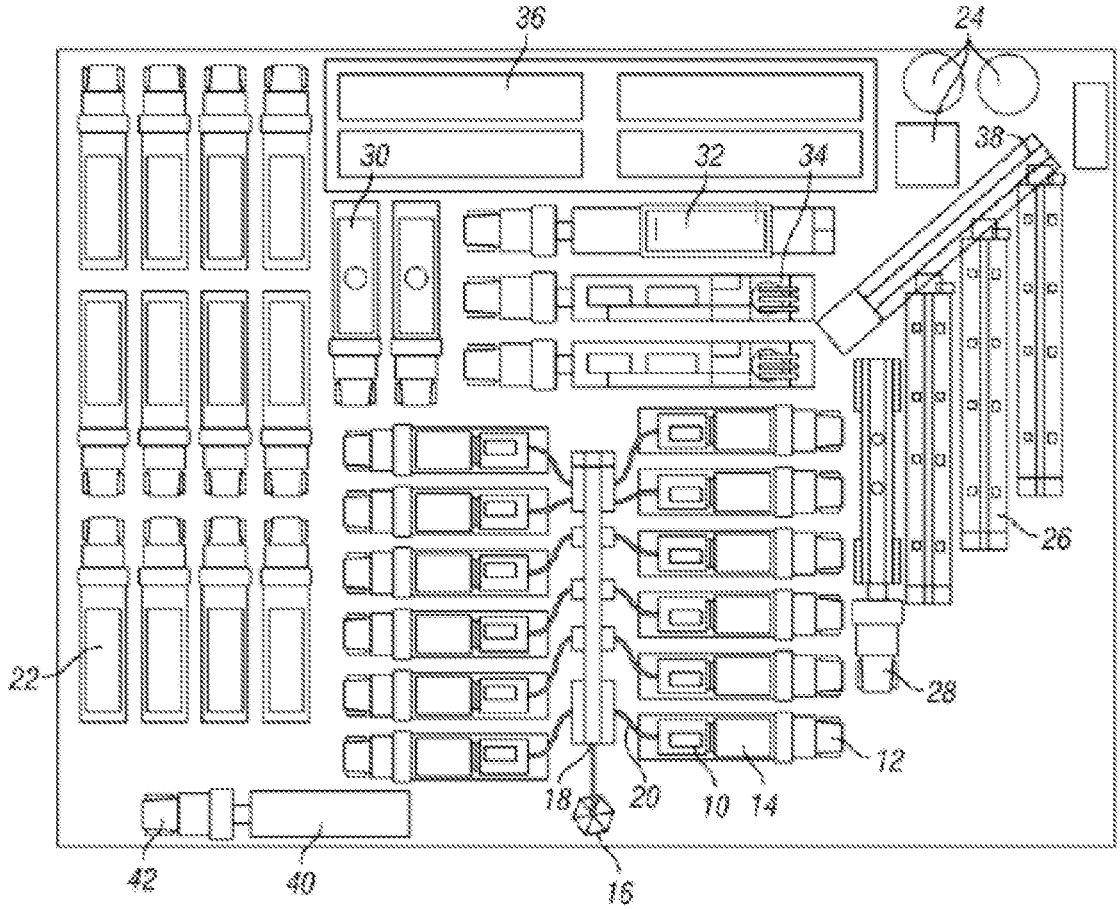
FIG. 1 is a schematic plan view of equipment used in a hydraulic fracturing operation, according to an embodiment of the present technology.

The foregoing aspects, features, and advantages of the present technology will be further appreciated when considered with reference to the following description of preferred embodiments and accompanying drawing, wherein like reference numerals represent like elements. In describing the preferred embodiments of the technology illustrated in the appended drawing, specific terminology will be used for the sake of clarity. However, the technology is not intended to be limited to the specific terms used, and it is to be understood that each specific term includes equivalents that operate in a similar manner to accomplish a similar purpose.

FIG. 1 shows a plan view of equipment used in a hydraulic fracturing operation. Specifically, there is shown a plurality of pumps 10 mounted to pump trailers 12. The pump trailers 12 can be trucks having at least two-three axles. In the embodiment shown, the pumps 10 are powered by electric motors 14, which can also be mounted to the pump trailers 12. The pumps 10 are fluidly connected to the wellhead 16 via a manifold trailer or similar system to the manifold trailer 18. As shown, the pump trailers 12 can be positioned near enough to the manifold trailer 18 to connect fracturing fluid lines 20 between the pumps 10 and the manifold trailer 18. The manifold trailer 18 is then connected to the wellhead 16 and configured to deliver fracturing fluid provided by the pumps 10 to the wellhead 16.

In some embodiments, each electric motor 14 can be capable of delivering about 1500 brake horsepower (BHP), 1750 BHP, or more, and each pump 10 can optionally be rated for about 1750 hydraulic horsepower (HHP) or more. In addition, the components of the system, including the pumps 10 and the electric motors 14, can be capable of operating during prolonged pumping operations, and in temperature in a range of about −20 degrees C. or less to about 50 degrees C. or more. In addition, each electric motor 14 can be equipped with a variable frequency drive (VFD) that controls the speed of the electric motor 14, and hence the speed of the pump 10. An air conditioning unit may be provided to cool the VFD and prevent overheating of the electronics.

The electric motors 14 of the present technology can be designed to withstand an oilfield environment. Specifically, some pumps 10 can have a maximum continuous power output of about 1500 BHP, 1750 BHP, or more, and a maximum continuous torque of about 11,488 lb-ft or more. Furthermore, electric motors 14 of the present technology can include class H insulation and high temperature ratings, such as about 400 degrees F. or more. In some embodiments, the electric motor 14 can include a single shaft extension and hub for high tension radial loads, and a high strength 4340 alloy steel shaft, although other suitable materials can also be used.

The VFD can be designed to maximize the flexibility, robustness, serviceability, and reliability required by oilfield applications, such as hydraulic fracturing. For example, as far as hardware is concerned, the VFD can include packaging receiving a high rating by the National Electrical Manufacturers Association (such as nema 1 packaging), and power semiconductor heat sinks having one or more thermal sensors monitored by a microprocessor to prevent semiconductor damage caused by excessive heat. Furthermore, with respect to control capabilities, the VFD can provide complete monitoring and protection of drive internal operations while communicating with an operator via one or more user interfaces. For example, motor diagnostics can be performed frequently (e.g., on the application of power, or with each start), to prevent damage to a shorted electric motor 14. The electric motor diagnostics can be disabled, if desired, when using, for example, a low impedance or high-speed electric motor.

In some embodiments, the pump 10 can optionally be a 2250 HHP triplex or quinteplex pump. The pump 10 can optionally be equipped with 4.5 inch diameter plungers that have an eight (8) inch stroke, although other size plungers (such as, for example, 4" 4.5", 5", 5.5", and 6.5") can be used, depending on the preference of the operator. The pump 10 can further include additional features to increase its capacity, durability, and robustness, including, for example, a 6.353 to 1 gear reduction, autofrettaged steel or steel alloy fluid end, wing guided slush type valves, and rubber spring loaded packing.

In addition to the above, certain embodiments of the present technology can include a skid or body load (not shown) for supporting some or all of the above-described equipment. For example, the skid can support the electric motor 14 and the pump 10. In addition, the skid can support the VFD. Structurally, the skid can be constructed of heavy-duty longitudinal beams and cross-members made of an appropriate material, such as, for example, steel. The skid can further include heavy-duty lifting lugs, or eyes, that can optionally be of sufficient strength to allow the skid to be lifted at a single lift point.

Referring back to FIG. 1, also included in the equipment is a plurality of electric generators 22 that are connected to, and provide power to, the electric motors 14 on the pump trailers 12. To accomplish this, the electric generators 22 can be connected to the electric motors 14 by power lines (not shown). The electric generators 22 can be connected to the electric motors 14 via power distribution panels (not shown). In certain embodiments, the electric generators 22 can be powered by natural gas. For example, the generators can be powered by liquefied natural gas. The liquefied natural gas can be converted into a gaseous form in a vaporizer prior to use in the generators. The use of natural gas to power the electric generators 22 can be advantageous because, where the well is a natural gas well, above ground natural gas vessels 24 can already be placed on site to collect natural gas produced from the well. Thus, a portion of this natural gas can be used to power the electric generators 22, thereby reducing or eliminating the need to import fuel from offsite. If desired by an operator, the electric generators 22 can optionally be natural gas turbine generators, such as those shown in FIG. 2.

FIG. 1 also shows equipment for transporting and combining the components of the hydraulic fracturing fluid used in the system of the present technology. In many wells, the fracturing fluid contains a mixture of water, sand or other proppant, acid, and other chemicals. Examples of fracturing fluid components include acid, anti-bacterial agents, clay stabilizers, corrosion inhibitors, friction reducers, gelling agents, iron control agents, pH adjusting/buffering agents, scale inhibitors, and surfactants. Historically, diesel has at times been used as a substitute for water in cold environments, or where a formation to be fractured is water sensitive, such as, for example, clay. The use of diesel, however, has been phased out over time because of price, and the development of newer, better technologies.

In FIG. 1, there are specifically shown sand storing vehicles 26, an acid transporting vehicle 28, vehicles for transporting other chemicals 30, and a vehicle carrying a hydration unit 32, containing a water pump. Also shown are fracturing fluid blenders 34, which can be configured to mix and blend the components of the hydraulic fracturing fluid, and to supply the hydraulic fracturing fluid to the pumps 10. In the case of liquid components, such as water, acids, and at least some chemicals, the components can be supplied to the blenders 34 via fluid lines (not shown) from the respective component vehicles, or from the hydration unit 32. Acid can also be drawn directly by a frac pump without using a blender or hydro. In the case of solid components, such as sand, the component can be delivered to the blender 34 by a conveyor belt 38. The water can be supplied to the hydration unit 32 from, for example, water tanks 36 onsite or a "pond." Alternately, the water can be provided by water trucks. Furthermore, water can be provided directly from the water tanks 36 or water trucks to the blender 34, without first passing through the hydration unit 32.

Monitor/control data van 40 can be mounted on a control vehicle 42, and connected to the pumps 10, electric motors 14, blenders 34, and other surface and/or downhole sensors and tools (not shown) to provide information to an operator, and to allow the operator to control different parameters of the fracturing operation. For example, the monitor/control data van 40 can include a computer console that controls the VFD, and thus the speed of the electric motor 14 and the pump 10. Other pump control and data monitoring equipment can include pump throttles, a pump VFD fault indicator with a reset, a general fault indicator with a reset, a main emergency "E-stop," a programmable logic controller for local control, and a graphics panel. The graphics panel can include, for example, a touchscreen interface.

The monitor/control data van 40 incorporate various functions in a centralized location such that compressors and turbines spread across a plurality of trucks can be monitored by a single operator. The functions can include: monitoring and control of the gas compression for the turbines (and in particular, of pressure and temperature, or load percentage), monitoring and control of the mobile turbines (and in particular, of pressure and temperature), monitoring and control of the electric distribution equipment, switchgear and transformers, monitoring and control of the variable frequency drives, monitoring and resetting faults on the variable frequency drives remotely without having to enter danger areas such has high pressure zone and high voltage zones, monitoring and control of the electric motors, monitoring and control of rate and pressure of the overall system, control for an emergency shut off that turns off the gas compressors, turbines, and opens all of the breakers in the switchgear, and monitoring and control of vertical sand silos and electrical conveyor belt. Sensors for monitoring pressure, temperature, fluid rate, fluid density, etc. may be selected as design considerations well within the understanding of one of ordinary skill in the art.

Monitoring and control for the above functions can be accomplished with cables (not shown), Ethernet, or wireless capability. In an embodiment, monitoring and control for the electric fleet can be sent offsite using satellite and other communication networks. The monitor/control data van 40 can be placed in a trailer, skid, or body load truck.

The monitor/control data van 40 further includes an Emergency Power Off (EPO) 43 functionality, which allows for the entire site to be shut off completely. For example, over CAT5E cabling, breakers will open in both switchgear to cut power to the site, and gas compression will turn off, cutting the connection for fuel to the turbine. The EPO 43 will be discussed further below with reference to FIG. 3. Additional controls may include, for example, the pumps, the blender, the hydration, and the fracturing units. The signals for such controls can include, for example, on/off, speed control, and an automatic over-pressure trip. In the case of an over-pressure event, the operator controlled push button for the on/off signal can be deployed immediately such that the pumps stop preventing overpressure of the iron.

Figure 2:
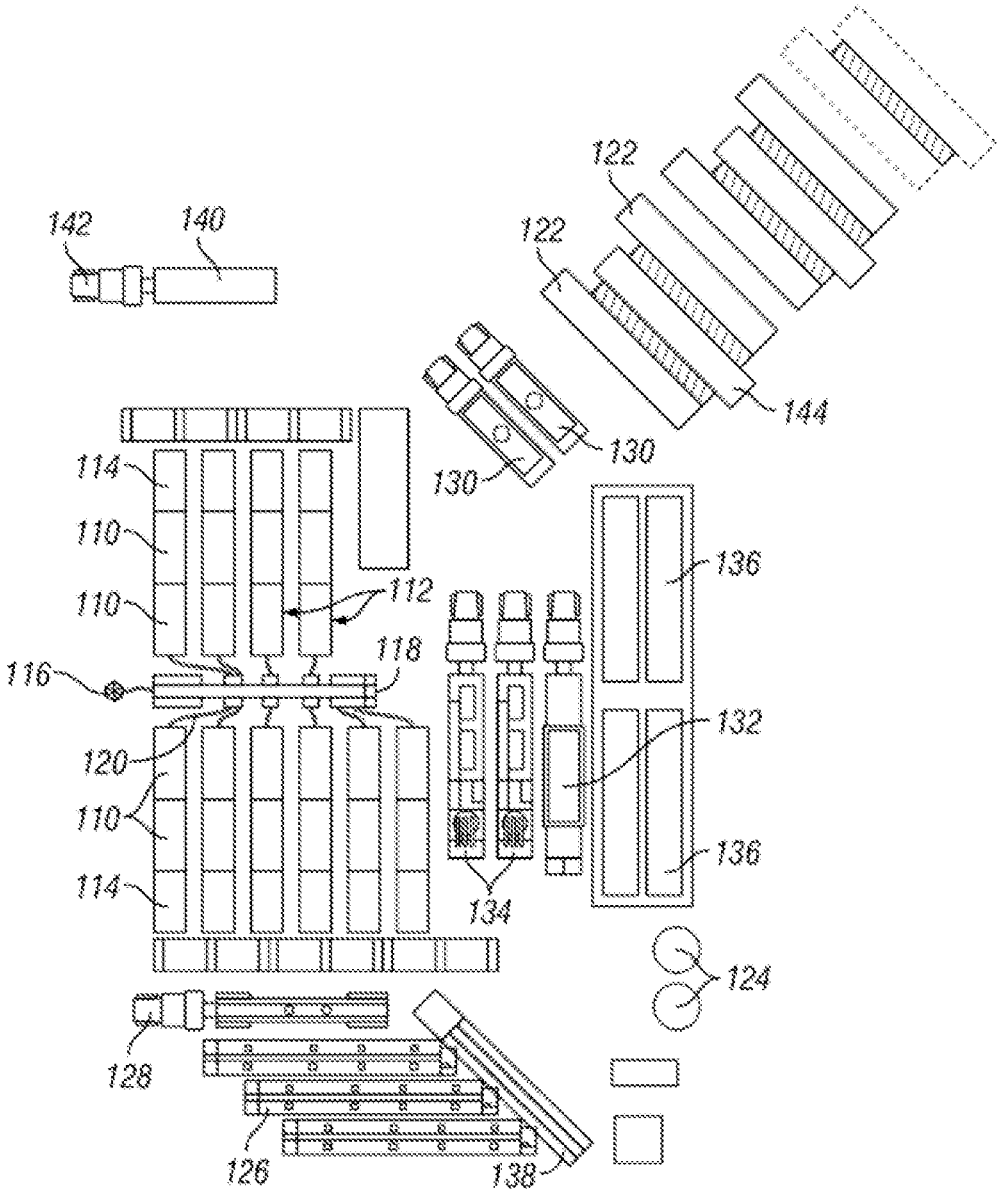
FIG. 2 is a schematic plan view of equipment used in a hydraulic fracturing operation, according to an alternate embodiment of the present technology.

Referring now to FIG. 2, there is shown an alternate embodiment of the present technology. Specifically, there is shown a plurality of pumps 110 which, in this embodiment, are mounted to pump trailers 112. As shown, the pumps 110 can optionally be loaded two to a trailer 112, thereby minimizing the number of trailers needed to place the requisite number of pumps at a site. The ability to load two pumps 110 on one trailer 112 is possible because of the relatively light weight of the electric pumps 110 compared to other known pumps, such as diesel pumps, as well as the lack of a transmission. In the embodiment shown, the pumps 110 are powered by electric motors 114, which can also be mounted to the pump trailers 112. Furthermore, each electric motor 114 can be equipped with a VFD that controls the speed of the motor 114, and hence the speed of the pumps 110.

In addition to the above, the embodiment of FIG. 2 can include a skid (not shown) for supporting some or all of the above-described equipment. For example, the skid can support the electric motors 114 and the pumps 110. In addition, a different skid can support the VFD. Structurally, the skid can be constructed of heavy-duty longitudinal beams and cross-members made of an appropriate material, such as, for example, steel. The skid can further include heavy-duty lifting lugs, or eyes, that can optionally be of sufficient strength to allow the skid to be lifted at a single lift point.

The pumps 110 are fluidly connected to a wellhead 116 via a manifold trailer 118. As shown, the pump trailers 112 can be positioned near enough to the manifold trailer 118 to connect fracturing fluid lines 120 between the pumps 110 and the manifold trailer 118. The manifold trailer 118 is then connected to the wellhead 116 and configured to deliver fracturing fluid provided by the pumps 110 to the wellhead 116.

Still referring to FIG. 2, this embodiment also includes a plurality of turbine generators 122 that are connected to, and provide power to, the electric motors 114 on the pump trailers 112 through the switchgear and transformers. To accomplish this, the turbine generators 122 can be connected to the electric motors 114 by power lines (not shown). The turbine generators 122 can be connected to the electric motors 114 via power distribution panels (not shown). In certain embodiments, the turbine generators 122 can be powered by natural gas, similar to the electric generators 22 discussed above in reference to the embodiment of FIG. 1. Also included are control units 144 (also referred to as EERs or Electronic Equipment Rooms) for the turbine generators 122.

The embodiment of FIG. 2 can include other equipment similar to that discussed above. For example, FIG. 2 shows sand transporting vehicles 126, acid transporting vehicles 128, other chemical transporting vehicles 130, hydration units 132, blenders 134, water tanks 136, conveyor belts 138, and pump control and data monitoring equipment 140 mounted on a control vehicle 142. The function and specifications of each of these is similar to corresponding elements shown in FIG. 1.

Use of pumps 10, 110 powered by electric motors 14, 114 and natural gas powered electric generators 22 (or turbine generators 122) to pump fracturing fluid into a well is advantageous over known systems for many different reasons. For example, the equipment (e.g. electric motors, radiators, transmission (or lack thereof), and exhaust and intake systems) is lighter than the diesel pump systems commonly used in the industry. The lighter weight of the equipment allows loading of the equipment directly onto a truck body. In fact, where the equipment is attached to a skid, as described above, the skid itself can be lifted on the truck body, along with all the equipment attached to the skid, in one simple action. Alternatively, and as shown in FIG. 2, trailers 112 can be used to transport the pumps 110 and electric motors 114, with two or more pumps 110 carried on a single trailer 112. Thus, the same number of pumps 110 can be transported on fewer trailers 112. Known diesel pumps, in contrast, cannot be transported directly on a truck body or two on a trailer, but must be transported individually on trailers because of the great weight of the pumps.

The ability to transfer the equipment of the present technology directly on a truck body or two to a trailer increases efficiency and lowers cost. In addition, by eliminating or reducing the number of trailers to carry the equipment, the equipment can be delivered to sites having a restricted amount of space, and can be carried to and away from worksites with less damage to the surrounding environment. Another reason that the electric pump system of the present technology is advantageous is that it runs on natural gas. Thus, the fuel is lower cost, the components of the system require less maintenance, and emissions are lower, so that potentially negative impacts on the environment are reduced.

Figure 3:
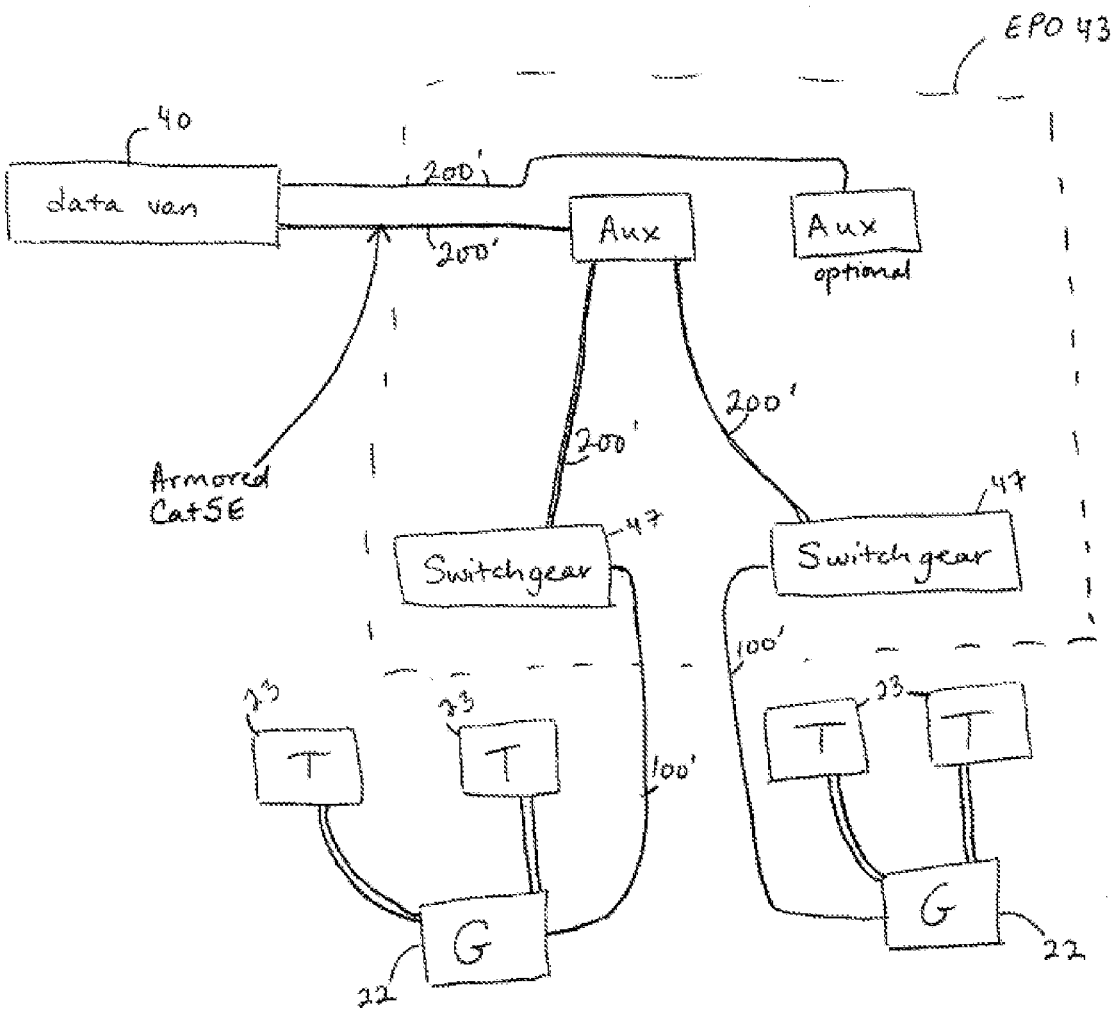
FIG. 3 is a schematic plan view of equipment used in a hydraulic fracturing operation, according to an embodiment of the present technology, including an emergency power off circuit.

Additionally, diesel fleets do not have gas compression, and are thus not amenable for an emergency power off configuration. Electric fleets, however, are amenable to an emergency power off configuration. Referring now to FIG. 3, the EPO 43 can include power (or optionally, plural auxiliary power sources) coupled to the monitor/control data van 40 via, for example, armored shielded CAT5E cabling to a switchgear 47. The switchgear 47 couples the data van 40 to turbine(s) 23 (or the EER(s) coupled to the turbines). In certain embodiments, the shielded CAT5E cabling may run from the data van 40, to an auxiliary trailer that includes switchgear 47, to a gas compressor (not shown), and to the EER/Turbine 23. Upon activation of the EPO 43, breakers open in the switchgear 47, cutting power to the generator 22. The gas compression will turn off, cutting fuel to the turbine(s) 23. Optionally, the EPO 43 is operated by a switch in the control vehicle 42 that sounds an audible alarm that the EPO 43 is imminently deployable. Alternatively, serial data and cables may be used instead of Ethernet.

In practice, a hydraulic fracturing operation can be carried out according to the following process. First, the water, sand, and other components are blended to form a fracturing fluid, which is pumped down the well by the electric-powered pumps. Typically, the well is designed so that the fracturing fluid can exit the wellbore at a desired location and pass into the surrounding formation. For example, in some embodiments the wellbore can have perforations that allow the fluid to pass from the wellbore into the formation. In other embodiments, the wellbore can include an openable sleeve, or the well can be open hole. The fracturing fluid can be pumped into the wellbore at a high enough pressure that the fracturing fluid cracks the formation, and enters into the cracks. Once inside the cracks, the sand, or other proppants in the mixture, wedges in the cracks, and holds the cracks open.

Using the monitor/control data van 40, the operator can monitor, gauge, and manipulate parameters of the operation, such as pressures, and volumes of fluids and proppants entering and exiting the well, as well as the concentration of the various chemicals. For example, the operator can increase or decrease the ratio of sand to water as the fracturing process progresses and circumstances change.

In an embodiment, a blender can be monitored from the monitor/control data van 40. Among the operating characteristics of the blender that can be monitored is Fluid Density. The fluid density can be monitored or controlled based on one or more of the following: a Vibration Densitometer, a Nuclear Densitometer, containing a small nuclear emitter with a gamma ray detector, Coriolis Meters for low flow rates, and clean volume vs. slurry volume calculations. Based on programmable logic controller (hereinafter "PLC") based densitometer density control, the blender will calculate how fast to run the augers to maintain a specific fluid density based on a user entered set point and the reading from the densitometer. Alternatively, with PLC based ratiometric density control, the blender will calculate how fast to run the augers to maintain a specific fluid density based on a user entered set point and the calculated rate from the sand augers. In still another embodiment, based on PLC based fluid density control, the blender will calculate now fast to run the augers to maintain a specific fluid density based on a user entered set point and reverse calculating the difference between the clean water suction rate and the slurry water discharge rate. The difference in rate is due to the volume of sand added.

The specific gravity and bulk density of the sand, the volume per revolution of the augers, auger priority, auger efficiency, and density target may be user entered either on the blender or in the monitor/control data van 40.

Also pertaining to the blender, chemical flow meters may be used to measure flow rate (gallons per minute for liquid, pounds per minute for dry additives). In terms of monitoring, a ½" Coriolis may be employed to monitor flowrate, volume total, temperature, pH, and/or density. In another embodiment, a 1" Coriolis may be employed to monitor flowrate, volume total, temperature, pH, and/or density. In still another embodiment, a 2" Coriolis may be employed to monitor flowrate, volume total, temperature, pH, and/or density. Certain embodiments may include a variety of flowmeters (and other sensors) of various sizes so as to account for varying flowrates and viscosities of chemicals being blended. For a dry chemical auger, an optical encoder may be provided for calculating additive rate, and/or a magnetic sensor for counting auger rotations (i.e., a Hall Effect sensor) may also be employed for monitoring.

In an embodiment, for blender control, a PLC based automatic control uses input from the chemical flowmeters or augers and matches the flow rate with the user entered set point either from the data van or locally from the blender operator. With manual control embodiments, the blender operator manually controls the chemical pump speed and attempts to match the set point.

In an embodiment, with respect to measuring chemicals into the blender, at the monitor/control data van 40 is it contemplated that measuring calculated totals (gallons for liquid, pounds or dry chemicals), a liquid chemical calculated concentration (gallons of chemical added per thousand gallons of fresh water "gpt" or "gal/1000 gal"), or dry chemical calculated concentration (pounds of chemical added per thousand gallons of fresh water "#pt" or "#/1000 gal") may be accomplished.

In an embodiment, at the blender pressure monitoring can be accomplished by, for example, a suction pressure transducer or discharge pressure transducer.

In an embodiment, the electrically powered fracking fleet can include a discharge motor. For the discharge motor, monitoring can include monitoring the VFD, such as the motor winding temperatures, the motor RPM, the voltage, the torque, and the current (amperage). Control of the discharge motor can include changing the motor RPM, the VFD algorithm, the voltage set point, and the discharge pump speed also controls the discharge pressure.

In an embodiment, the electrically powered fracking fleet can include a hydraulic motor. For the hydraulic motor, monitoring can include monitoring the soft starter, the motor winding temperatures, the motor RPM, the voltage, the torque, and the current (amperage). Control of the hydraulic motor can include running or disabling the motor.

In an embodiment, the electrically powered fracking fleet can include vibration monitoring for the equipment, including the hydraulic motor, discharge motor, suction pump, discharge pump, discharge manifold, discharge iron, and suction hoses.

In an embodiment, the electrically powered fracking fleet can include hydraulic system monitoring for the equipment, including the system pressure, the charge pressure, the temperature, the hydraulic oil level, and the filter status.

In an embodiment, the electrically powered fracking fleet can include electrical power monitoring, including total kilowatt consumption, the system voltage, the current draw (either per power cable or total).

In an embodiment, the electrically powered fracking fleet can include air pressure monitoring at the suction pump, including the RPM, the hydraulic pressure at the pump motor, and the calculated rate.

In an embodiment, the electrically powered fracking fleet can include monitoring of the sand hopper weight using load cells. Optionally, the system can include cameras so the operator can visually see the hopper from inside the data van or blender cabin.

In an embodiment, the electrically powered fracking fleet can include sand augers. From the data van, the monitoring can include the auger RPM, the calculated sand concentration (Pounds of sand/proppant added "PPA" or "PSA"), the sand stage total (pounds), and/or the sand grand total (pounds). Density control may be either automatic, or manual. Control of the loading allows the operator to load the auger without the computer calculating or totalizing the sand volume or reporting it to the monitor/control data van 40.

While fluid rate is mostly controlled by the fracturing pumps, in an embodiment, fluid rate monitoring may also be accomplished by the electrically powered fracking fleet. The monitored characteristics from the blender can include the calculated clean rate (barrels per minute "BPM"), the calculated dirty rate, the measured clean rate (as obtained by a turbine flow meter or magnetic flow meter), and the measured dirty rate (as obtained by a turbine flow meter or magnetic flow meter). The dirty rate can also be calculated from the frac pumps. Each pump may include an optical encoder (or magnetic sensor) to count the pump strokes so as to determine the BPM per pump, which can then be combined for a total dirty rate of all the pumps.

In an embodiment, the valve status for various equipment can also be monitored, including at the inlet, the outlet, the tub bypass, and the crossover. In another embodiment, the tub level can be obtained based on float, radar, laser, or capacitive measurements.

In an embodiment, the electrically powered fracking fleet can include a hydration unit having chemical flow meters to measure flow rate (gallons per minute for liquid, pounds per minute for dry additives). For example, in an embodiment, in terms of monitoring, a ½" Coriolis may be employed to monitor flowrate, volume total, temperature, pH, and/or density. In another embodiment, a 1" Coriolis may be employed to monitor flowrate, volume total, temperature, pH, and/or density. In another embodiment, a 2" Coriolis can be employed to monitor flowrate, volume total, temperature, pH, density, and/or viscosity. In an embodiment, a recirculation pump may be used to monitor mixed fluid in the tub, including viscosity, pH, and temperature.

In an embodiment, at the hydration unit, PLC based automatic control uses input from the chemical flowmeters and matches the flow rate or concentration with the user entered set point either from the monitor/control data van 40 or locally from the blender operator. Alternatively, using manual control, the blender operator manually controls the chemical pump speed and attempts to match the set point.

At the hydration unit, with regards to control, chemical measurements can be automated, in particular calculated totals (gallons), liquid chemical calculated concentration (gallons of chemical added per thousand gallons of fresh water "gpt" or "gal/1000 gal").

In an embodiment, pressure monitoring at the hydration unit can be accomplished via, for example, a suction pressure transducer or a discharge pressure transducer.

In an embodiment, monitoring at the hydraulic motor of the hydration unit can include soft starter, motor winding temperatures, motor RPM, voltage, torque, current (amperage), and control can include both running and disabling the motor.

In an embodiment, monitoring at the hydraulic motor of the hydration unit can include vibration monitoring of the hydraulic motor, the fluid pumps, and discharge manifold and hoses.

In an embodiment, monitoring at the hydraulic motor of the hydration unit can include hydraulic system monitoring, including of operating characteristics such as system pressure, charge pressure, temperature, hydraulic oil level, and filter status.

In an embodiment, monitoring at the hydraulic motor of the hydration unit can include electrical power monitoring, including of operating characteristics such as total kilowatt consumption, system voltage, current draw (both per power cable and total). In an embodiment, monitoring at the hydraulic motor of the hydration unit can include tub paddle speed monitoring.

In an embodiment, monitoring at the hydraulic motor of the hydration unit can include fluid rate monitoring (though fluid rate is mostly controlled by the blender), including operating characteristics such as measured clean rate, via a turbine flow meter or magnetic flow meter.

In an embodiment, monitoring at the hydraulic motor of the hydration unit can include monitoring the valve status, including inlet, outlet, and crossover. In an embodiment, monitoring at the hydraulic motor of the hydration unit can include tub level, measured by, for example, a float, radar, laser, or capacitive sensor(s).

In the monitor/control data van 40, a pump control station allows for remote control of operating characteristics of the pumps including, for example, RPM, enable/disable, and pressure trip Set point. The pump control station can also include the Emergency Stop, stops all pumps substantially instantaneously, as discussed further herein.

In an embodiment, the pump control station can also include a VFD fault reset. In an embodiment, the pump control station can also include an auto pressure feature, allowing the pump control operator to set a max pressure and/or target pressure and the software will automatically adjust the combined pump rate to ensure that the target pressure is sustained and/or the max pressure is not exceeded. In an embodiment, the pump control station can also include an auto rate feature, allowing the pump control operator to set a target fluid rate and the software automatically controls the combined pump rates to meet the set point. In an embodiment, the pump control station also allows for remote monitoring of operating characteristics such as pump discharge pressure, wellhead iron pressure, motor winding temperatures, blower motor status, calculated pump rate, lube pressure, and/or bearing temperatures. In an embodiment, the pump control station also allows for remote monitoring of operating characteristics such as VFD information including, but not limited to, kilowatt load, current, voltage, load percentage, VFD temperature, power factor, torque load, faults. In an embodiment, the pump control station also allows for remote monitoring of operating characteristics relating to the compressors or turbines, discussed more fully below.

In the monitor/control data van 40, a treater station allows for remote control of various operating characteristics relating to the blender. For example, chemical set points such as flow rate, concentration, and enable/disable can be set. Additional operating characteristics that can be monitored or controlled can include pump k-factors, chemical schedule, density (sand) schedule, sand auger priorities, sand auger bulk densities, sand auger specific gravity, sand auger efficiency, sand auger control mode (whether ratiometric, densitometer, or fluid), and enable/disable.

In an embodiment, the treater station of the monitor/control van 40 also enables remote monitoring of chemical flow rates, chemical concentration, slurry flow rate via turbine or magnetic sensor, clean flow rate via turbine or magnetic sensor, pressures based on suction and/or discharge.

In an embodiment, the treater station of the monitor/control van 40 also enables remote monitoring of density, based on measurements from nuclear, vibration, or Coriolis measurements. The treater station can also enable monitoring of auger RPM, auger control, and auger priority.

Fluid flow rates can be obtained from a turbine flowmeter or magnetic flowmeter. Pressures can be obtained based on discharge or suction. In an embodiment, the treater station of the monitor/control van 40 also enables remote monitoring of fluid pH, fluid viscosity, and fluid temperature.

Personnel control and radio communications allow the monitor/control data van 40 operator to monitor and control the equipment operators at the site. An engineering station of the monitor/control data van 40 graphs and records everything the treater station and pump control station monitor, provides insight into the sand silo weights, and can optionally broadcasts live data to offsite viewers. Also at the engineering station, the Emergency Power Off can be configured to disable all equipment and open switchgear breakers substantially instantaneously.

In an embodiment, the electrically powered fracking fleet can include a fracturing pump. In an embodiment, the pump can be controlled locally through an onboard user interface that will need to be individually operated. In an embodiment, the pump can be controlled remotely by using a wired or wireless connection to a mobile user interface (often called a suitecase). Alternatively, the pump can be controlled by the monitor/control data van 40 pump control station by using either a wired or wireless connection; the monitor/control data van 40 can control all pumps simultaneously. Among the operating characteristics that can be controlled are the RPM, the local pressure trip set point, and enable/disable.

In an embodiment, operating characteristics of the fracturing pump that can be monitored include discharge pressure, calculated pump rate, lube oil pressure, suction pressure, blower motor status, pump run status. In an embodiment, operating characteristics of the motor of the fracturing pump that can be monitored can include RPM, winding temperatures, bearing temperatures, kilowatt draw, torque load, voltages, currents, and temperature warnings.

In an embodiment, operating characteristics of the VFD of the fracturing pump that can be monitored can include kilowatt load, current, voltage, load percentage, VFD temperature, power factor, torque load, and faults.

In an embodiment, operating characteristics relating to the vibrations of the fracturing pump that can be monitored can include the fluid end, power end, discharge iron, coupler, the VFD housing, the blower, and the chassis.

In an embodiment, the electrically powered fracking fleet can include a switch gear. Operating characteristics relating to the switch gear that can be monitored include the Emergency Power Off Status, the breaker status, the voltage, the current, the kilowatts, the breaker temperature(s), the enclosure temperature, the status of the fire alarm, and the ground fault. Control of the switch gear can be accomplished by opening circuit breakers, either remotely or locally, with internal or external switching.

In an embodiment, the electrically powered fracking fleet can include sand equipment such as silos. Monitoring can be accomplished with wireless communications to the monitor/control data van 40, relaying operating characteristics such as weight (load cells), volume obtained by measurements by laser, nuclear, ultrasonic, or radar. Control of operational characteristics for the silos can include opening or closing sand outlets with a wireless remote control, swinging the sand chute left or right with a wireless remote control, and control of the sand conveyor.

Specific to the dual belt sand conveyor, monitoring can include operating characteristics such as the motor RPM, the motor winding temperatures, the motor bearing temperatures, the motor kilowatt draw, the motor torque load, the motor voltages, the motor currents, and the motor temperature warnings, as well as the actual belt speed. Control of the sand conveyor can include motor enable/disable, and belt speed.

In an embodiment, the electrically powered fracking fleet can include a dust collector vacuum unit. Monitoring the dust collector vacuum unit can include operating characteristics such as the motor RPM, the motor winding temperatures, the motor bearing temperatures, the motor kilowatt draw, the motor torque load, the motor voltages, the motor currents, the motor temperature warnings, the vacuum pressure, the dust bag status, and the filtration status. Control of the dust collector vacuum unit can include enable/disable, as well as emergency off.

In an embodiment, the electrically powered fracking fleet can include an Auxiliary Unit. The auxiliary unit includes capability to monitor the VFD, including operating characteristics of the auxiliary unit VFD such as kilowatt load, current, voltage, load percentage, VFD temperature, power factor, torque load, and faults. The operating characteristics of the auxiliary unit that can be controlled include drive voltage and drive current.

In an embodiment, monitoring the transformer of the auxiliary unit can also be accomplished. Operating characteristics that can be monitored include kilowatt load percentage, kilowatt power, voltage input, voltage output, current input, current output, winding temperatures, and enclosure temperature.

In an embodiment, the electrically powered fracking fleet can include one or more chemical transports (such as, for example, acid tankers). Operating characteristics that can be monitored for the chemical transports include flow rate, turbine acid (both measured based on, for example magnetic or Coriolis. Other operating characteristics that can be monitored include amount of remaining product, based on weight (using load cells), level or pressure. The level can be monitored based on tank float, capacitive sensor (if the transport carries liquid), laser, ultrasonic, or radar. Control between the transports and the monitor/control van can include opening or closing valves and isolating compartments.

In an embodiment, the electrically powered fracking fleet can include a high pressure iron. The operating characteristics of the high pressure iron that can be monitored can include, for example, pressure between the wellhead and check valve, pressure between the check valve and manifold trailer, the backside pressure (measured at wellhead base, pressure from in between the casing), and vibration.

In an embodiment, the electrically powered fracking fleet can include a gas filtration skid. The operating characteristics of the gas filtration skid that can be monitored can include, for example, water separator status, particulate filter status, gas Pressures (at the inlet, outlet, or internal), gas temperatures (at the inlet, outlet, or internal), valve statuses (open/closed), and filter bypass status. The operating characteristics of the gas filtration skid that can be controlled can include, for example, the inlet valves, outlet valves, bypass valves, and pressure release (i.e., blow off).

In an embodiment, the electrically powered fracking fleet can include a gas compressor. Operating characteristics of the gas compressor that can be monitored can include, for example, compressor motor run status, cooler fan run status, oil pump run status, enclosure exhaust fan run status, inlet valve position, compressor oil isolation valve position, heater oil isolation valve position, power supply alarm, emergency stop alarm, 20% LEL Gas Alarm, 40% LEL Gas Alarm, oil separator low alarm, compressor run fail, oil pump run fail, cooler fan run fail, cooler fan vibration switch, inlet valve position alarm, inlet pressure low shutdown (automated), inlet pressure low alarm, compressor discharge pressure high shutdown (automated), compressor discharge pressure high alarm, skid discharge pressure high alarm, skid discharge pressure high shutdown (automated), oil filter differential pressure high alarm, oil over discharge differential pressure low shutdown, oil over discharge differential pressure low alarm, compressor discharge temperature high alarm, compressor discharge temperature high shutdown, compressor oil supply temperature high alarm, compressor oil supply temperature high shutdown, skid gas discharge temperature high alarm, skid gas discharge temperature high shutdown, compressor suction vibration high alarm, compressor suction vibration high shutdown, skid enclosure temperature high alarm, skid enclosure temperature high shutdown, compressor oil isolation valve position alarm, heater oil isolation valve position alarm, compressor discharge vibration high alarm, compressor discharge vibration high shutdown, compressor motor vibration high alarm, compressor motor vibration high shutdown, compressor motor winding high temperature alarms, compressor motor winding high temperature shutdown, compressor motor bearing drive end high temperature alarm, compressor motor bearing drive end high temperature shutdown, compressor motor bearing non drive end high temperature alarm, compressor motor bearing non drive end high temperature shutdown, knockout drum high level alarm, skid enclosure high temperature alarm, oil pump flow failure alarm, cooler high vibration switch alarm, skid enclosure fan run failure, oil sump heater run failure, compressor inlet pressure, compressor discharge pressure, oil pump discharge pressure, compressor oil supply pressure, skid discharge pressure, skid gas inlet temperature, compressor discharge temperature, oil sump temperature, compressor oil supply temperature, gas/oil cooler outlet temperature, skid discharge temperature, skid enclosure temperature, compressor slide valve position, compressor motor stator phase RTD, compressor motor drive end bearing RTD, and compressor motor non drive end bearing RTD.

In an embodiment, the electrically powered fracking fleet can include a gas compressor. Operating characteristics of the gas compressor that can be controlled can include, for example, skid run command, emergency power off, and fire shutdown.

In an embodiment, the electrically powered fracking fleet can include a turbine. Operating characteristics of the turbine that can be monitored can include, for example, calibration faults, node channel faults, node communication faults, IEPE power fault, internal power fault, program mode status, module fault, module power fault, controller battery voltage low, controller key switch position alert, forces enabled, forces installed, controller logic fault, backup over speed monitor system test required, backup over speed monitor speed tracking error, controller task overlap time exceeded, turbine control channel fault, 120 Vdc battery charger failure, turbine air inlet duct transmitter failure, turbine air inlet filter high, control system 24 Vdc supply voltage high/low, secondary control system 24 Vdc supply voltage high/low, controller failed to download configuration parameters to quantum premier, quantum premier node fault, quantum premier read failure, quantum premier enclosure water mist system fault, CO2 extended valve switch position fail, CO2 extended line discharge, CO2 valves to vent with enclosure unprotected, CO2 primary line discharged, CO2 primary valve switch position fail, enclosure fire alarm, QPR EDIO configuration fault, fire system inhibited with enclosure unprotected, enclosure fire system manual discharge activated, enclosure fire system trouble, turbine enclosure combustible gas level high, electrical release inhibited with CO2 not isolated, flame detector dirty lens, gas sensor configuration error, turbine enclosure vent fan failure, and/or turbine enclosure vent filter.

Operating characteristics of the turbine that can be also monitored can include, for example, turbine enclosure pressure low, turbine enclosure pressure low (while fire system is inhibited), turbine enclosure temperature high, auto synchronization failure, CGCM1 configuration failure, CGCM1 excitation output short, CGCM1 hardware excitation off, CGCM1 read failure, digital load share control channel fault, digital load share control communication fail, digital load share control communication fail unit speed mode set to droop, digital load sharing logic fault, generator kW high exceeding drive train limitations, generator over excitation limiting active, generator phase rotation fault, generator rotating diode open fault, generator under excitation limiting active, generator phase winding temperature high, guide vane actuator force transmitter failure, gas fuel flow transmitter failure, main gas fuel valve command high—low gas fuel pressure, gas fuel main valve DP low—low gas fuel pressure, gas fuel pilot valve command high—low gas fuel pressure, gas fuel pilot valve DP low—low gas fuel pressure, gas fuel temperature high/low, gas main fuel vent failure, gas fuel vent failure, gas fuel vent LP failure, gas fuel valve check secondary failure to open or control valves leaking, gas fuel valve check primary failure to open or secondary leaking, gas fuel pressure too low to check valves, gas fuel control valve high pressure leak check failure, gas fuel valve high pressure leak check failure, gas fuel valve low pressure leak check failure, main gas fuel valve tracking check failure, gas fuel vent valve check failure, guide vane actuator force high, gas producer delayed over speed, gas producer maximum continuous speed exceeded, gas producer compressor discharge pressure signal difference high, flameout switch appears failed open, gas producer compressor discharge pressure transmitter failure, gas fuel supply pressure high, gas fuel supply pressure low, gas fuel shutoff valves pressure alarm, and/or gas fuel control valve pressure high.

Operating characteristics of the turbine that can be also monitored can include, for example, fuel system air supply pressure transmitter failure, fuel system air supply pressure high/low, thermocouple input module thermistor failure, thermocouple input module thermistor A vs B fault, low emissions mode disabled due to T1 RTD failure, T5 compensation out of limits, T5 delayed temperature high, T5 thermocouple reading high, T5 thermocouple failure, turbine air inlet temperature RTD Failure, XM BAM band max peak amplitude high, burner acoustic monitor signal failure from XM system, starter motor temperature high, NGP slow roll speed low, slow roll sequence interrupted, start VFD configuration failure, start VFD fault, start VFD turbine node fault, backup lube oil pump test failure, backup system relay failure, post lube resumed with fire detected, lube oil tank level low, lube oil filter DP high, AC lube oil pump discharge pressure switch failure, backup lube oil pump discharge pressure switch failure, lube oil tank pressure high, lube oil header pressure high/low, lube oil tank temperature RTD failure, lube oil header temperature high/low, lube oil header temperature low start delayed for warm up, engine bearing XM tachometer signal fault, engine GP thrust bearing temperature high, generator bearing temperature high, engine bearing X-Axis or Y-Axis radial vibration high, generator velocity vibration high, gearbox acceleration vibration high, gas fuel coalescing filter DP high, gas fuel coalescing filter-heater summary alarm, gas fuel heater alarm, gas fuel heater shutdown switch to liquid, filter liquid level hi lower section, generator real power external set point analog input range check fail, test crank sequence timeout, and/or 120 Vdc battery charger failure.

Operating characteristics of the turbine that can be also monitored can include, for example, turbine air inlet filter transmitter failure, turbine air inlet filter DP high, CGCM1 failure, CGCM1 CNet node fault, loss of generator circuit breaker auxiliary contact signal, generator excitation loss, generator kW high, exceeding drive train limitations, generator over voltage, generator PMG loss, generator protection relay cool down initiate, generator reverse VAR, generator rotating diode short fault, generator sensing loss, generator under voltage, generator phase winding temperature RTD failure, and/or generator phase winding temperature high.

Operating characteristics of the turbine that can be also monitored can include, for example, gas producer delayed over speed, gas producer maximum continuous speed exceeded, T5 delayed temperature high, lube oil filter DP high, lube oil filter inlet pressure transmitter failure, lube oil header temperature RTD failure, lube oil header temperature high, lube oil header temperature low with start inhibited, gas fuel heater fault, gas fuel skid pressure low—probable leak, filter liquid level hi FV-1 upper section, filter liquid level hi FV-2 upper section, normal stop from auxiliary terminal, normal stop from customer hardwire, normal stop from customer terminal, normal stop from local terminal, normal stop from remote terminal, normal stop skid, normal stop from station terminal, gas fuel temperature high, gas producer compressor discharge pressure signal difference high, gas producer compressor discharge pressure transmitter failure, thermocouple input module multiple thermistor failure, multiple T5 thermocouple failure, turbine air inlet temperature RTD failure, gas fuel control temperature RTD failure, lube oil tank level low, lube oil tank pressure transmitter failure, lube oil tank pressure high, inlet block valve position mismatch, blowdown valve position mismatch, CGCM1 fault, generator circuit breaker failure to open, generator over current, generator over excitation, generator over frequency, generator reverse kW, and/or generator under frequency.

Operating characteristics of the turbine that can be also monitored can include, for example, guide vane actuator fault, guide vane position transmitter failure, guide vane actuator over temperature, main gas fuel valve actuator fault, main gas fuel valve position transmitter failure, main gas fuel valve actuator over temperature, pilot gas fuel valve actuator fault, pilot gas fuel valve position transmitter failure, pilot gas fuel valve actuator over temperature, engine flameout detected by high fuel command, engine flameout detected by high fuel flow, engine flameout detected by low engine temperature, engine under speed possibly due to flameout, gas fuel main valve discharge pressure difference high, main gas fuel valve position failure, gas fuel pilot valve discharge pressure difference high, gas fuel pilot valve position failure, gas fuel valve check failure, gas fuel valve suction pressure difference high, guide vane actuator position failure, high start gas fuel flow, ignition failure, gas producer acceleration rate low, gas producer over/under speed, flameout switch failure to transfer on shutdown, fail to accelerate, fail to crank, crank speed high, crank speed low, starter motor temperature high, start VFD fault, and/or start VFD turbine CNet node fault.

Operating characteristics of the turbine that can be also monitored can include, for example, backup lube oil pump test failure, lube pressure decay check failure, pre/post lube oil pump failure, backup lube oil pump failure, backup lube pressure decay check failure, lube oil tank temperature low start permissive, engine bearing 1 X-axis, Y-axis radial vibration high, generator DE velocity vibration high, generator EE velocity vibration high, gearbox acceleration vibration high, backup over speed, backup speed probe failure, backup over speed detected vs backup system latch active mismatch, external watchdog fault, fast stop latch, controller executed first pass, microprocessor fail vs backup system latch active mismatch, backup over speed monitor analog over speed, backup over speed monitor processor test fail, backup over speed monitor system test fail, backup over speed monitor speed tracking error, backup over speed monitor speed transmitter failure, control system 24 Vdc supply voltage low, secondary control system 24 Vdc supply voltage low, turbine enclosure combustible gas level high, enclosure fire detected, enclosure fire detected vs backup system latch active mismatch, enclosure fire system discharged, turbine enclosure gas detected vs backup system latch active mismatch, turbine enclosure combustible gas detection level high during prestart, turbine enclosure vent fan run failure start permissive, turbine enclosure vent fan 1 fail start permissive, turbine enclosure pressure transmitter failure, turbine enclosure pressure low, turbine enclosure temperature RTD failure, and/or turbine enclosure temperature high.

Operating characteristics of the turbine that can be also monitored can include, for example, generator failure to soft unload, generator protection relay fast stop initiate, main gas fuel valve manual test active during turbine start, pilot gas fuel valve manual test active during turbine start, gas fuel temperature high, gas fuel temperature low, guide vane actuator force high, guide vane actuator manual test active during turbine start, main gas metering AOI error, loss of gas producer speed signal, gas producer maximum momentary speed exceeded, gas producer compressor discharge pressure dual transmitter failure, pilot gas metering AOI error, gas fuel supply pressure transmitter failure, gas fuel supply pressure high, gas fuel valve check pressure transmitter failure, gas fuel shutoff valves pressure high, gas fuel control pressure transmitter failure, gas fuel control valve pressure high, gas fuel main valve discharge pressure transmitter failure, gas fuel main valve discharge pressure transmitter #2 failure, gas fuel pilot valve discharge pressure transmitter failure, gas fuel pilot valve discharge pressure transmitter #2 failure, primary gas fuel shutoff valve output module failure, secondary gas fuel shutoff valve output module failure, T5 instantaneous temperature high, delayed single T5 thermocouple high, single T5 thermocouple high, T5 thermocouples fail to completely light around, low start pressure lube oil inhibit, backup system relay failure, lube pump output module failure, possible engine bearing failure due to interrupted post lube, possible engine bearing failure due to low header pressure while rotating, lube oil header pressure transmitter failure, lube oil header pressure low, and/or lube oil tank temperature RTD failure.

Operating characteristics of the turbine that can be also monitored can include, for example, engine GP thrust bearing temperature RTD failure, engine GP thrust bearing temperature high, generator DE bearing temperature RTD failure, generator DE bearing temperature high, generator EE bearing temperature RTD failure, generator EE bearing temperature high, emergency stop customer, emergency stop customer vs backup system latch active mismatch, emergency stop skid turbine control panel vs backup system latch active mismatch, fast stop skid (turbine control panel), system off lockout, backup over speed monitor system test pass, startup acceleration active, cooldown, ignition, engine not ready to run (i.e., clear the alarms), on load, pre-start, pre-crank mode summary, purge crank, ready to load, ready to run, driver running, starter dropout speed established, driver starting, driver stopping, test crank, on-line cleaning shutoff valve open, on-crank cleaning shutoff valve open, on-crank water wash enabled, on-line water wash enabled, all CO2 valves to vent, CO2 extended valve to enclosure, CO2 extended valve to vent, CO2 primary valve to enclosure, CO2 primary valve to vent, turbine enclosure is being purged, turbine enclosure vent fan 1 run command ON, and/or enclosure ventilation interrupt possible.

Operating characteristics of the turbine that can be also monitored can include, for example, water mist dampers commanded to close, auto sync frequency matched, auto sync phase matched, auto sync phase rotation matched, auto sync voltage matched, bus phase rotation ACB, bus voltage trim active, bus voltage trim enabled, CGCM1 configuration complete, CGCM1 excitation output enabled, CGCM power meters preset complete, dead bus synchronization enable, digital load share control unit communication fail, generator auto voltage regulation control active, generator circuit breaker auto sync active, generator circuit breaker closed, generator circuit breaker close command, generator circuit breaker tripped, excitation field current regulation control active, excitation field current regulation control selected, generator kVAR load sharing active, generator kW control mode active, generator load sharing active, generator PF control mode active, generator phase rotation ACB, generator soft unload, generator VAR control mode active, grid mode droop load control mode active, generator grid mode operation, grid speed droop selected, grid voltage droop selected, and/or grid mode voltage droop control active.

Operating characteristics of the turbine that can be also monitored can include, for example, generator unloading active, utility circuit breaker closed, kVAR control selected, PF control selected, gas valve check—fuel control valve(s) leak check test active, gas valve check control valve tracking test active, guide vane actuator enabled, gas fuel control valve enabled, gas fuel pilot control valve enabled, main gas fuel valve manual test active, pilot gas fuel valve manual test active, fuel control inactive, gas fuel valve manual test mode permissive, gas main vent in progress, gas fuel valve check sequence complete, gas fuel valve check in progress, guide vane cycle test active, guide vane cycle test failed, guide vane cycle test passed, guide vane manual cycle test enabled, guide vane actuator manual test mode active, guide vane actuator manual test mode permissive, gas valve check initial venting is active, light off, light off ramp control mode, load control mode, igniter energized, max fuel command mode, minimal fuel control mode, gas producer acceleration control mode, off skid gas fuel bleed valve tripped—manual reset required to close, off skid gas fuel block valve tripped—manual reset required to open, off-skid gas fuel system vented to off-skid gas fuel block valve, gas valve check—primary shutoff leak check test active, gas valve check—secondary shutoff leak check test active, SoLoNOx control minimum pilot mode, SoLoNOx control mode active, and/or SoLoNOx control mode enabled.

Operating characteristics of the turbine that can be also monitored can include, for example, start ramp control mode, bleed valve control valve energized, primary gas fuel shutoff valve energized, gas fuel vent valve energized, secondary gas fuel shutoff valve energized, gas fuel torch valve energized, T5 temperature control mode, engine at crank speed, slow roll enabled, slow roll mode, start VFD configuration complete, start motor VFD parameter configuration enabled, start motor VFD parameter configuration in progress, start VFD run command ON, backup lube oil pump test failed, backup lube oil pump test passed, backup lube oil pump run command ON, backup lube oil pump pressurized, backup lube oil pump test in progress, controller active relay set, lube oil engine turning mode, lube oil engine turning and post lube mode, lube oil cooler fan 1 run command, lube oil header pressurized, lube oil tank heater ON, lube oil tank level low, post lube active, lube oil post lube mode, lube oil pre engine turning mode, lube oil pre lube mode, pre/post lube oil pump run command ON, pre/post lube oil pump pressurized, lube oil pump check mode, backup pump check request during restart without complete pump check required, gas fuel filter-heater online, gas fuel filter-heater on purge, gas fuel skid healthy, gas fuel heater on enable, gas fuel inlet block valve closed, gas fuel inlet block valve open, gas fuel blowdown valve ON=CLOSED, and/or gas fuel blowdown valve open.

Operating characteristics of the turbine that can be also monitored can include, for example, alarm acknowledge, alarm summary, system reset initiated from auxiliary display, flash card full or not present, cooldown lock-out summary, cooldown non-lock-out summary, system control auxiliary, system control customer, system control local, system control remote, customer set point tracking enabled, system reset from customer interface, default configuration mode active, fast stop lock-out summary, fast stop non-lock-out summary, external kW set point enabled, system reset initiated from local display, system reset initiated from local terminal, log ready for review, system reset from remote terminal, shut down summary, external speed set point enabled, system reset from station terminal, logging total counts reset, save trigger log data, user defined configuration active, user defined operation mode grid PF control mode selected, user defined operation mode grid kW control mode selected, user defined operation mode grid speed droop control mode detected, user defined operation mode grid voltage droop control mode selected, user defined operation mode island VR constant voltage control mode selected, user defined operation mode island VR kVAR LS mode selected, user defined operation mode island speed droop selected, user defined operation mode island speed Isoch selected, and/or user defined operation mode island VR droop selected.

Operating characteristics of the turbine that can be also monitored can include, for example, external voltage set point enabled, backup over speed monitor speed, backup over speed monitor System test speed delta, expected backup over speed monitor trip set point, calculated backup over speed monitor trip speed, control system 24 Vdc supply voltage, secondary control system 24 Vdc supply voltage, turbine air inlet DP, turbine air inlet filter DP, #1 turbine enclosure inlet combustible gas sensor LEL, fuel area combustible gas sensor LEL, turbine enclosure exhaust combustible gas sensor LEL, turbine enclosure pressure, enclosure purge time remaining, turbine enclosure temperature, enclosure vent fan interrupt time remaining, bus average line-to-line voltage, bus phase voltage, bus frequency, bus phase AB voltage, bus phase BC voltage, bus phase CA voltage, load share control unit network number, generator field current set point, generator average current, generator average line-to-line voltage, generator average power factor, generator auto voltage regulation set point, generator excitation current, generator excitation ripple, generator excitation voltage, generator filtered total real power, generator frequency, generator GVAR hours, generator GVA hours, generator GW hours, generator kVAR set point, generator kW set point, generator MVAR hours, generator total MVA hours, generator MVA hours, generator MVA total hours, generator MW hours, generator total MW hours, generator power factor set point, generator phase AB voltage, generator phase A current, generator phase A winding temperature, generator phase BC voltage, generator phase B current, generator phase B winding temperature, generator phase CA voltage, generator phase C current, generator phase C winding temperature, generator total apparent power, generator total reactive power, and/or generator total real power.

Operating characteristics of the turbine that can be also monitored can include, for example, digital load share control unit group number (for all units), digital load share control unit PU KVAR (for all units), digital load share control unit PU KW (for all units), Fuel System Air Supply Pressure (for all units), Engine Cooldown Time Remaining (for all units), Gas Producer Compressor Discharge Pressure (for all units), and/or Gas Producer Compressor Discharge Pressure (for all units).

Operating characteristics of the turbine that can be also monitored can include, for example, engine serial number, fuel control total fuel demand, gas fuel control pressure, gas fuel control temperature, gas fuel flow, gas fuel main valve discharge pressure, gas fuel main valve discharge pressure signal low winner, gas fuel percent of total flow to pilot manifold, gas fuel pilot percent set point, gas fuel pilot valve discharge pressure, gas fuel pilot valve discharge pressure signal low winner, gas fuel supply pressure, gas fuel valve suction pressure signal high winner, gas fuel valve check pressure, guide vane actuator command, guide vane actuator force, guide vane actuator position feedback, maximum GV force amplitude this hour, main gas fuel valve command, main gas fuel valve position feedback, maximum fuel command limit, minimum fuel command limit, gas producer speed, maximum recorded NGP above maximum momentary speed, gas producer speed set point, percent load corrected for T1 and elevation, pilot gas fuel valve command, and/or pilot gas fuel valve position feedback.

Operating characteristics of the turbine that can be also monitored can include, for example, ready to load time remaining, SoLoNOx control disable set point, SoLoNOx control enable set point, SoLoNox control T5 set point, air inlet temp RTD failure time remaining before shutdown, air inlet temperature, number of active T5 thermocouples, average T5 temperature, T5 compensator, T5 max reading, T5 maximum to minimum spread, T5 thermocouple, T5 set point, burner acoustic monitor overall amplitude, maximum burner acoustic monitor overall amplitude this hour, restart time remaining, slow roll time remaining, start VFD DC bus voltage, start VFD drive status, start VFD fault code, starter motor current, starter motor frequency, starter motor power, start VFD motor power factor, starter motor voltage, start VFD digital input status, lube oil filter DP, lube oil filter inlet pressure, lube oil header pressure, lube oil header temperature, lube oil tank pressure, lube oil tank temperature, post lube interrupt lockout time remaining, post lube time remaining, and/or pre-lube time remaining.

Operating characteristics of the turbine that can be also monitored can include, for example, engine rundown time remaining, engine bearing vibrations, engine purge time remaining, exhaust purge time remaining, engine efficiency actual, engine efficiency difference, engine efficiency predicted, engine heat flow actual, engine heat rate actual, engine heat rate difference, engine heat rate predicted, engine PCD difference, engine predicted PCD, engine power difference, engine power full load, engine power predicted, engine power reserve, engine T5 difference, engine T5 predicted, fuel flow gas output, generator reactive power set point from customer terminal, generator real power set point from remote terminal, generator power factor set point from customer terminal, speed set point from customer terminal, generator voltage set point from customer terminal, engine fired hour count, main gas fuel valve manual test set point, pilot main gas fuel valve manual test set point, generator hour count, number of successful generator starts, guide vane actuator manual test set point, generator real power external set point in kW, manual NGP set point, reference temperature, generator reactive power set point from remote terminal, generator real power set point from remote terminal, generator power factor set point from remote terminal, speed set point from remote terminal, generator voltage set point from remote terminal, RGB hour count, number of successful RGB starts, engine start count, generator reactive power set point from station terminal, generator real power set point from station terminal, generator power factor set point from station terminal, speed set point from station terminal, and/or generator voltage set point from station terminal.

Operating characteristics of the turbine that can also be controlled can include, for example, auto synchronize initiate command, bus voltage trim disable/enable, customer set point tracking disable/enable command from customer terminal, customer control disable command from the customer terminal, generator circuit breaker trip, disable generator soft unload from island mode, enable generator soft unload from island mode, set default generator control modes, set user defined generator control modes, horn silence, select speed droop island mode, island mode select speed isoch, island mode VR constant voltage control select, island mode VR droop select, island mode kVAR load sharing select, disable/enable external kW set Point, start manual back up lube pump check, initiate manual cycle test, preset MW/MVAR/MVA hour counters, run at rated volts and frequency disabled/enabled, remote control enable command from the customer terminal, reset command from customer terminal, disable external speed set point, enable external speed set point, turbine start, starter VFD configuration request, normal stop, test crank start/stop, disable external voltage set point customer terminal, enable external voltage set point customer terminal, automatic voltage regulation mode select, excitation field current regulation mode select, on crank cleaning start/stop, on line cleaning start/stop, generator reactive power set point from customer terminal, generator real power set point from customer terminal, generator power factor set point from customer terminal, speed set point from customer terminal, and/or generator voltage set point from customer terminal.

This process of injecting fracturing fluid into the wellbore can be carried out continuously, or repeated multiple times in stages, until the fracturing of the formation is optimized. Optionally, the wellbore can be temporarily plugged between each stage to maintain pressure, and increase fracturing in the formation, or to isolate stages to direct fluid to other perforations. Generally, the proppant is inserted into the cracks formed in the formation by the fracturing, and left in place in the formation to prop open the cracks and allow oil or gas to flow into the wellbore.

While the technology has been shown or described in only some of its forms, it should be apparent to those skilled in the art that it is not so limited, but is susceptible to various changes without departing from the scope of the technology. Furthermore, it is to be understood that the above disclosed embodiments are merely illustrative of the principles and applications of the present technology. Accordingly, numerous modifications can be made to the illustrative embodiments and other arrangements can be devised without departing from the spirit and scope of the present technology as defined by the appended claims.

What is claimed is:

1. A system for hydraulically fracturing an underground formation in an oil or gas well to extract oil or gas from the formation, the oil or gas well having a wellbore that permits passage of fluid from the wellbore into the formation, the system comprising:

an electric pump fluidly connected to the well, and configured to pump fluid into the wellbore; and a centralized control unit coupled to the electric pump, wherein the centralized control unit is configured to:

monitor the electric pump;

a variable frequency drive that controls a speed of the electric pump; and a generator electrically connected to the electric pump to provide power to the electric pump, wherein the generator is powered by natural gas, and wherein the centralized control unit is further configured to monitor and control compression of the natural gas;

wherein the centralized control unit is further configured to reset a fault occurring in the variable frequency drive.

2. The system of claim 1, wherein the generator is a turbine generator, and wherein the centralized control unit is further configured to monitor and control the turbine generator.

3. The system of claim 1, wherein the electric pump is a plurality of electric pumps.

4. The system of claim 3, further comprising: a variable frequency drive that controls the plurality of electric pumps.

5. The system of claim 1, further comprising an emergency power off unit coupled to the centralized control unit, the electric pump, and the generator, wherein the emergency power off unit is configured to cut power from the generator when activated.

6. The system of claim 5, the emergency power off unit comprising an auxiliary power and a switchgear each coupled to the generator and the centralized control unit, wherein the switchgear is responsive to a signal from the centralized control unit to open a breaker to cut power to the generator.

7. A method, comprising:

pumping fracturing fluid into a well in a formation with an electrically powered pump, the fracturing fluid having at least a liquid component and a solid proppant, and inserting the solid proppant into the cracks to maintain the cracks open;

monitoring at a centralized control unit the electrically powered pump;

controlling the speed of the pump with a variable frequency drive, wherein the centralized control unit is configured to reset a fault occurring in the variable frequency drive;

powering the electrically powered pump with a generator, wherein the generator is fueled by natural gas; and monitoring compression of natural gas.

8. The method of claim 7, wherein the natural gas is selected from the group consisting of field natural gas, compressed natural gas, and liquid natural gas.

9. The method of claim 7, further comprising controlling compression of natural gas, wherein the generator is fueled by natural gas.

10. The method of claim 7, wherein the generator is a turbine generator, the method further comprising monitoring the turbine generator.

11. The method of claim 7, wherein the generator is a turbine generator, the method further comprising controlling the turbine generator.

12. The method of claim 7, further comprising resetting a fault occurring in the variable frequency drive from the centralized control unit.

13. The method of claim 7, further comprising:

providing an emergency power off unit coupled to the centralized control unit, the electrically powered pump, and the generator; and cutting power to the generator by activating the emergency power off unit.

14. The method of claim 13, the emergency power off unit comprising an auxiliary power and switchgear, each coupled to the generator and the centralized control unit, the method further comprising signaling the switchgear from the centralized control unit to open a breaker to cut power to the generator.

15. A system for centralized monitoring and control of a hydraulic fracturing operation, comprising:

an electric powered fracturing fleet, the electric powered fracturing fleet comprising:

a combination of one or more of an electric powered pump, a turbine generator, a blender, a sand silo, a chemical storage unit, a conveyor belt, a manifold trailer, a hydration unit, a variable frequency drive, a switchgear, a transformer, and/or a compressor;

a centralized control unit coupled to electric powered fracturing fleet; and an emergency power off unit coupled to the centralized control unit, the electric powered pumps, and the turbine generators, the emergency power off unit configured to cut power to the turbine generators when activated, wherein the centralized control unit is configured to monitor and control one or more operating characteristics of the electric powered fracturing fleet; and wherein the centralized control unit is further configured to monitor and control compression of natural gas.

16. The system of claim 15, the emergency power off unit comprising an auxiliary power and switchgear each coupled to the generators and the centralized control unit, the switchgear responsive to a signal from the centralized control unit to open a breaker to cut power to the turbine generators.

17. The system of claim 15, wherein the centralized control unit is further configured to monitor and control the turbine generators.

* * * * *